United States Patent [19]

Beaulieu

[11] 4,356,648

[45] Nov. 2, 1982

[54] FRAMING SYSTEM FOR DISPLAY PANELS

[75] Inventor: Bryan J. Beaulieu, Burnsville, Minn.

[73] Assignee: Rupp Industries, Inc., Burnsville, Minn.

[21] Appl. No.: 261,886

[22] Filed: May 8, 1981

[51] Int. Cl.[3] ..... G09F 1/12; A47G 1/06; B25G 3/00

[52] U.S. Cl. ..... 40/155; 40/156; 40/152; 403/405

[58] Field of Search ..... 40/152, 152.1, 152.2, 40/155, 156, 154; 403/405, 295, 297, 402, 406, 407, 408, 409; 52/656, 657, 288, 564

[56] References Cited

U.S. PATENT DOCUMENTS

| | | | |
|---|---|---|---|
| 2,075,588 | 3/1937 | Meyers | 40/152 |
| 2,804,952 | 9/1957 | Nothdurft | 40/152 |
| 3,552,708 | 1/1971 | Hillstrom | 40/152.1 |
| 4,124,323 | 11/1978 | Freeman | 40/155 |
| 4,271,619 | 6/1981 | Schmidt | 40/155 |

*Primary Examiner*—Robert Peshock
*Assistant Examiner*—Michael J. Foycik
*Attorney, Agent, or Firm*—Orrin M. Haugen; Thomas J. Nikolai

[57] ABSTRACT

Frame means for releasably retaining and exhibiting objects upon a display surface, with the frame means including angularly disposed edge members releasably secured together with corner members and with mounting brackets releasably secured to the edge members for temporarily mounting the frame means upon a display surface. The edge members include a generally "E" shaped member having a back with three fingers extending therefrom including inner, outer and intermediate fingers, and with the outer and intermediate fingers forming a partially enclosed channel therebetween. The corner members include a central arcuate segment with interlocking tabs extending from each end of the arcuate segment. The tabs include a segment of reduced thickness for engagement with the edge members in the partially enclosed channel. The mounting brackets are in the form of a generally open bilateral triangle with two elongated legs joined together at the apex. One of the elongated legs is utilized to provide engagement with the display surface, and with the short leg of the triangle consisting of a segment turned upon itself to form a clip means for releasable engagement within the partially enclosed channel.

4 Claims, 4 Drawing Figures

FRAMING SYSTEM FOR DISPLAY PANELS

BACKGROUND OF THE INVENTION

The present invention relates generally to a panel display means, and more particularly to a frame arrangement for releasably retaining and exhibiting objects upon a display surface. The frame includes edge members and corner members, with the edge members being formed as an extrusion of indefinite length, and being capable of being conveniently cut to any length desired so as to form a frame with the desired dimensions and area.

The frame means of the present invention has particular application for use in connection with displays that change or are otherwise altered from time to time, and wherein the elements displayed on the arrangement do not necessarily correspond in size. For example, the frame means of the present invention is particularly adapted for use in displays which are temporarily set up from time to time, such as, for example, for sales programs, conventions, seminars, and the like.

The edge members are preferably formed as extrusion elements having a length which is at least as great as the largest dimension contemplated in the frame. For any application requiring a smaller dimension, the edge member is simply cut to the desired length and re-fit into a completed frame. The corner members are adapted to engage edge members of any length, hence the arrangement is readily adapted for use in connection with a portable display frame.

SUMMARY OF THE INVENTION

Therefore, it is a primary object of the present invention to provide a frame means for releasably retaining and exhibiting objects, particularly two-dimensional objects, upon a display surface, and wherein the frame means comprises edge members which are adapted for cutting to random length to form a framed display panel having any desired dimension.

It is a further object of the present invention to provide a frame means for releasably retaining and exhibiting objects upon a display surface wherein the frame is formed of edge members releasably secured together with corner members, and with mounting brackets releasably secured to the edge members, and with the mounting brackets having means to retain said frame means upon a display surface.

It is still a further object of the present invention to provide an improved frame means for releasably retaining and exhibiting two-dimensional objects upon a display surface, wherein the frame means includes edge members and corner members secured together, along with a plurality of mounting brackets which are engagable with the edge members, and wherein the entire assembly may be taken apart for receipt of a different display object, and wherein the edge members may be conveniently cut to any desired length so as to provide a display frame having any desired length and width.

Other and further objects of the present invention will become apparent to those skilled in the art upon a study of the following specification, appended claims, and accompanying drawing.

DESCRIPTION OF THE PREFERRED EMBODIMENT

Figure 1:
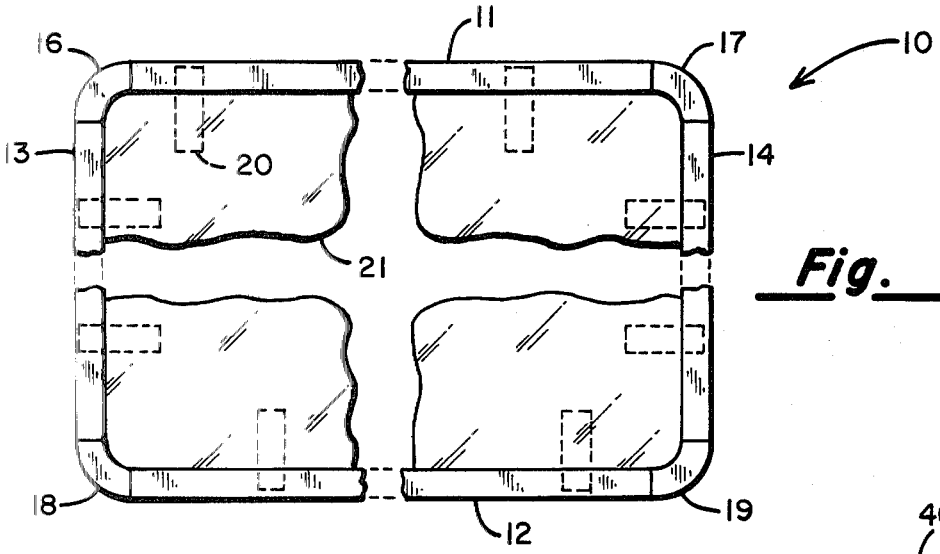
FIG. 1 is a plan view of the front surface of the frame means of the present invention, with central portions being cut away for purposes of simplicity, and showing in phantom the interconnecting segments of the cutaway portions.

In accordance with the preferred embodiment of the present invention, and with particular attention being directed to FIG. 1, the frame means generally designated 10 includes a pair of edge members 11 and 12 forming the top and bottom respectively of the frame, along with edge members 13 and 14 forming the sides of the frame and panel formed thereby. Corner members are illustrated at 16, 17, 18 and 19, with each of the corner members 16–19 being identical, one to another. The mounting brackets are illustrated in phantom in FIG. 1, but are shown in greater detail in FIGS. 2 and 4, with mounting bracket 20 being illustrated in perspective in FIG. 2 and in elevation in FIG. 4. A backing member is shown in FIGS. 1 and 2 as at 21.

Figure 2:
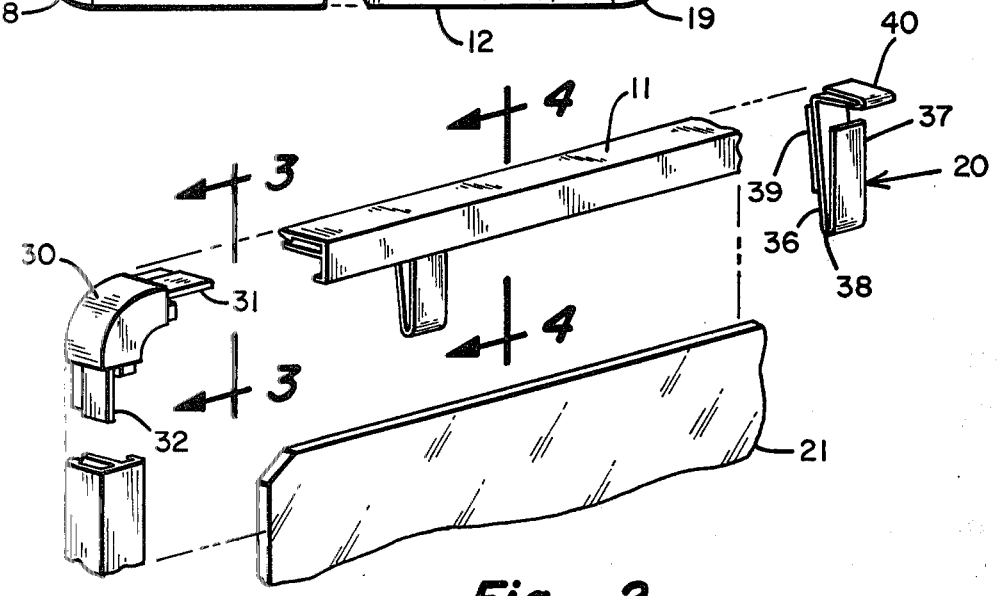
FIG. 2 is a partial exploded perspective view of one corner of the frame means shown in FIG. 1, and illustrating a segment of each of two edge members together with a corner member, and a mounting bracket removed from the remaining components of the assembly, with FIG. 2 being shown on a slightly enlarged scale from that of FIG. 1.
Figure 4:
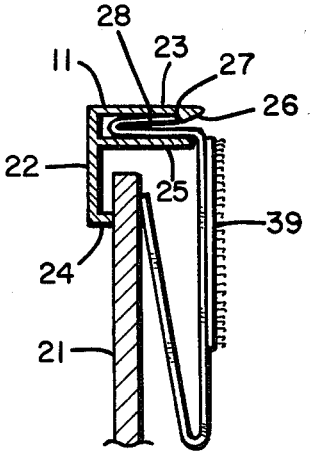
FIG. 4 is a vertical sectional view taken along the line and in the direction of the arrows 4—4 of FIG. 2.

Referring now specifically to the edge member, particularly edge member 11 in FIGS. 2 and 4, edge member 11 comprises a generally "E" shaped member with a back segment 22, along with three fingers extending therefrom including an outer finger 23, an inner finger 24, and an intermediate finger 25. Outer finger 23 is provided with an in-turned lip adjacent the outer tip thereof, as at 26, with the lip providing a shoulder as at 27. The combination of outer finger 23 and intermediate finger 25, along with the inwardly extending lip forms a partially enclosed channel as at 28. The inner finger 24 is in the form of a flange, and is utilized to provide a lip which engages the backing pad 21, with finger 24 engaging backing pad 21 along its end.

Figure 3:
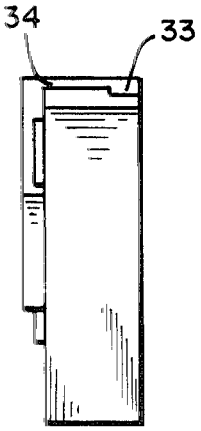
FIG. 3 is a vertical sectional view taken along the line and in the direction of the arrows 3—3 of FIG. 2.

The corner pads, as illustrated in FIGS. 2 and 3, comprise a central arcuate segment portion 30 with interlocking tabs 31 and 32 extending therefrom. The interlocking tabs include segments of reduced thickness, as at 33, with the portions of reduced thickness being adapted to be received within and adjacent the in-turned lip 26 of the edge members, such as edge member 11. Also, the interlocking tabs are offset inwardly from the periphery of the central arcuate segments to present a smooth profile, with the offset zone being shown in FIGS. 2 and 3 as at 34.

Turning now to the detail of the mounting bracket 20, this component is in the form of a generally open bilateral triangle with two elongated legs 36 and 37. Legs 36 and 37 are joined at the apex of the generally open bilateral triangle as at 38. Leg 36 has secured thereto a pad member having a plurality of hooks extending therefrom, as at 39, with such hooks being known in the art as "Velcro" elements.

The third leg of the bilateral triangle, as at 40, consists of a segment turned upon itself to form a clip means arranged for releasable engagement within the partially enclosed channel area 28 of the edge elements, as typically illustrated in edge element 11.

The overall frame means of the present invention is arranged to releasably retain and exhibit objects upon a display surface, with the frame means comprising, in continuation with one another, angularly disposed edge members secured together with corner members. The edge members are preferably formed as continuous elements, and are arranged to be cut to whatever length desired, so as to form a frame means with the ability of having randomly selected dimensions as may be required for the display operation from time to time.

I claim:

1. Frame means for releasably retaining and exhibiting objects upon a display surface, said frame means comprising, in continuation with one another, angularly disposed edge members releasably secured together with corner members, and mounting brackets releasably secured to said edge members and having means for releasably mounting said frame means upon a display surface, and a backing pad for objects being exhibited within said frame means;

(a) said edge members comprising a generally "E" shaped channel member having a back with three fingers extending therefrom including inner, outer and intermediate fingers, said outer finger having an in-turned lip adjacent the outer tip thereof, and with a partially enclosed channel formed between said outer and intermediate fingers;

(b) said corner members comprising a central arcuate segment with interlocking tabs extending away from said central arcuate segment, said interlocking tabs including segments of reduced thickness along the length thereof for engagement with said edge member in said partially enclosed channel;

(c) said mounting brackets being in the form of a generally open bilateral triangle with two elongated legs joined together at the apex, and having a first elongated leg with an engagement surface exposed toward said display retaining surface, said second elongated leg being adapted to engage said backing pad at the free end thereof, the third leg of said bilateral triangle consisting of a segment turned upon itself to form a clip means arranged for releasable engagement within said partially enclosed channel.

2. The frame means as defined in claim 1 wherein said display surface is provided with plural loops and said engagement surface is provided with plural hooks.

3. The frame means as defined in claim 1 being particularly characterized in that said frame means is adapted to releasably retain and exhibit two-dimensional objects upon a display surface.

4. The frame means as defined in claim 1 being particularly characterized in that said interlocking tabs are offset inwardly from the periphery of said central arcuate segment to present a smooth profile consistent with the exposed outer surface of said edge member back.

* * * * *